United States Patent [19]

Farrell et al.

[11] Patent Number: 5,010,215

[45] Date of Patent: Apr. 23, 1991

[54] ELECTRICAL SWITCHING MECHANISM

[76] Inventors: Jonathon E. Farrell; Mark C. Anthony, both of 8 Chomley Street, Cranbourne, Victoria, Australia, 3977

[21] Appl. No.: 373,293

[22] PCT Filed: Oct. 14, 1988

[86] PCT No.: PCT/AU88/00405

§ 371 Date: Aug. 1, 1989

§ 102(e) Date: Aug. 1, 1989

[87] PCT Pub. No.: WO89/03582

PCT Pub. Date: Apr. 20, 1989

[30] Foreign Application Priority Data

Oct. 16, 1987 [AU] Australia ..... PI4965

[51] Int. Cl.[5] ..... H01H 9/22

[52] U.S. Cl. ..... 200/50 A; 200/61.62

[58] Field of Search ..... 200/50 R, 50 A, 61.62, 200/333, 334, 573

[56] References Cited

U.S. PATENT DOCUMENTS 1,515,206 11/1924 Huey ..... 200/50 A 2,452,403 10/1948 Stukart ..... 200/50 A 4,703,147 10/1987 Happ et al. ..... 200/61.62 X

*Primary Examiner*—J. R. Scott

*Attorney, Agent, or Firm*—Andrus, Sceales, Starke & Sawall

[57] ABSTRACT

An electric switch actuating mechanism for use in monitoring fluid control valves such as those used in fire services controls a micro-switch (5) or electronic switch which forms part of an external supervisory circuit. The switch (5) is housed within a common housing (8) with the mechanism. The mechanism comprises a pivoting actuator (24) which is spring (27) biased to a first position and may be pivoted to a second position to actuate the switch (5) by an operator (28). The operator (28) is contacted from externally of the housing by a contact member (38) on a valve spindle (51) when the valve is in the normally open position. The actuator (24) is on a floating pivot (26) and is held in proper operating position by push-rods (36) and pins (37) which are retained in position by a lid (2) of the housing. When the lid is removed the pivot (26) moves to a position wherein movement of the operator (28) will not cause the actuator (24) to operate the switch (5).

7 Claims, 3 Drawing Sheets

ELECTRICAL SWITCHING MECHANISM

BACKGROUND OF THE INVENTION

This invention relates to a switch actuating mechanism and more particularly to an electric switch mechanism for use in association with an electric switch for monitoring the position of a fluid control valve.

In various fire sprinkler installations it is considered at least desirable and in some instances compulsory due to legislation to monitor that various valves of the hydraulic system are in a normal operating position and are not in some other position that might render them ineffective.

Thus, a water supply line for a sprinkler system may be fitted with an on-off valve which can be put to the off position for various maintenance reasons. However, for the sprinkler system to be effective that valve must be returned to the on position after the maintenance is completed. Since errors might occur it has become at least desirable that a means is provided for monitoring whether that valve is in the on or off position. Such monitoring may be conducted remotely such as at a distant fire station.

It is relatively easy matter to provide an electrical circuit incorporating a switch which can be actuated by some movement of a valve operator to become an open or closed circuit. However, maintenance on the switch itself may be required or the switch may need to be removed for some reason and it is conceivable that a human error might occur rendering the sprinkler system unable to operate but which, to a casual observer, appears to be in full working order.

In many other instances besides fire sprinkler systems similar problems may arise such as at oil refineries and on ships.

SUMMARY OF THE PRESENT INVENTION

Accordingly, the present invention seeks to provide a switch having a self disabling feature when various work is done on the switch itself.

The present invention provides an electrical switch mechanism comprising a housing, a switch actuator within the housing, biasing means biasing the switch actuator towards a first position, an operator member adapted to undergo a movement to cause the actuator to move against said biasing means to a second position, a removable access cover for providing access within the housing and means responsive to removal of said cover adapted to put the mechanism in a condition such that said movement is incapable under normal conditions of use of moving the actuator to said second position.

BRIEF DESCRIPTION OF THE DRAWING

A specific construction of a switch incorporating a switch mechanism in accordance with the present invention will now be described with the aid of the accompanying drawings in which.

DESCRIPTION OF THE PREFERRED EMBODIMENTS

Figure 1:
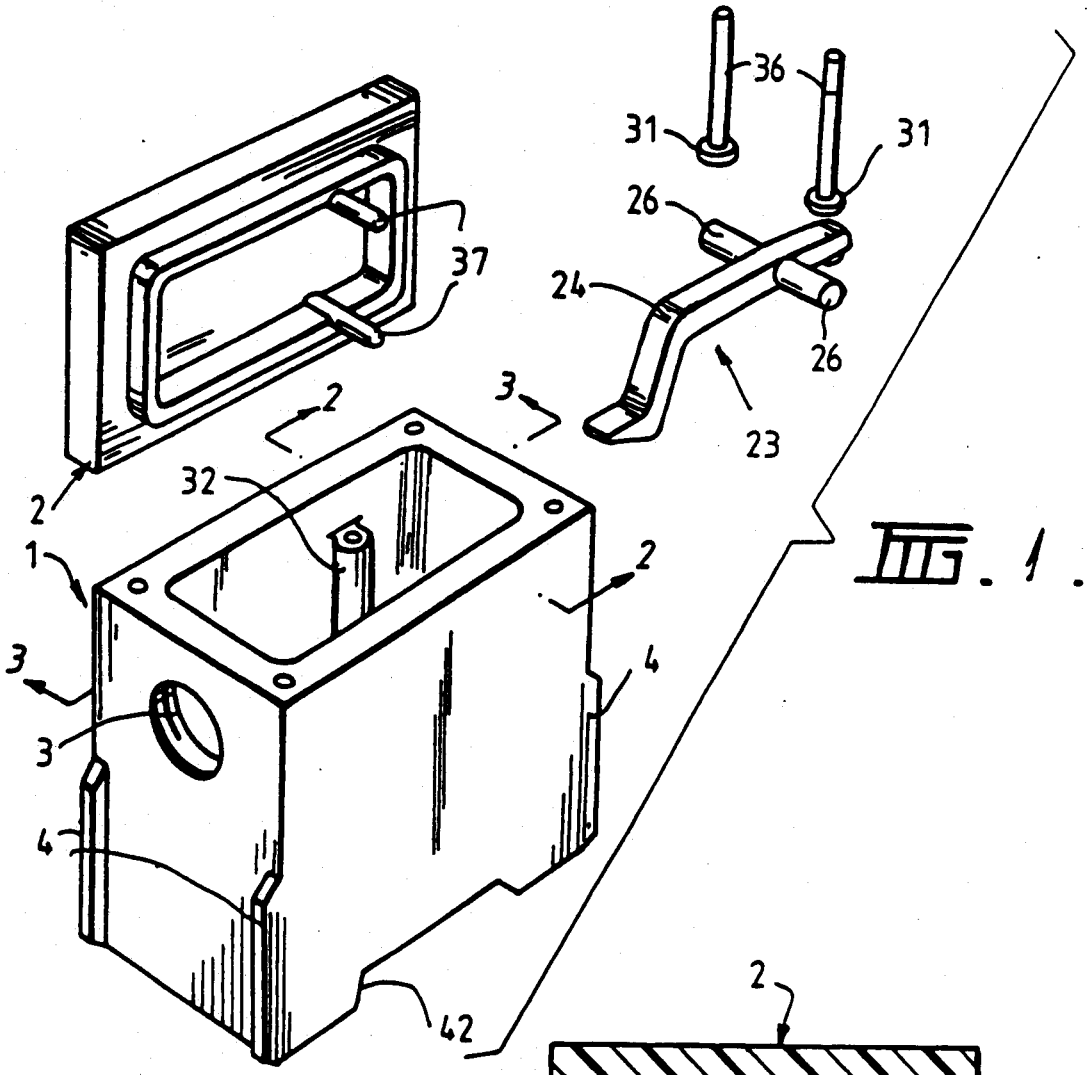
FIG. 1 is a perspective view of a switch housing incorporating a switch actuating mechanism, with the cover removed.

The switch shown in the drawings comprises a housing comprised of a body 1 and a cover 2. The body 1 has an access hole 3 for electrical cable and mounting lugs 4.

Within the body is a partition 6 which divides the body into a connections chamber 7 and a switch chamber 8.

In use of the switch a terminal block 55 is provided in the connections chamber 7 and wires of a cable 57 which pass through the hole 3 are connected to the terminal block 55 and further wires 59 pass from the terminal block 55 to a switch 5. The wires 59 to the switch 5 are embedded in a sealant compound (not shown) which also serves to seal the chambers 7 and 8 from one another.

The switch 5 is a normally open circuit switch and is provided with a plunger 23.

Figure 2:
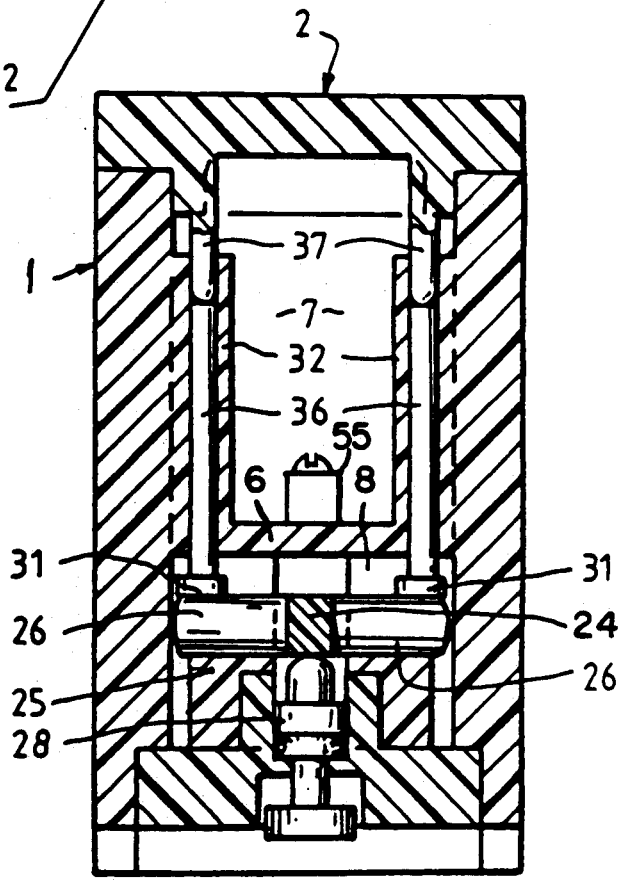
FIG. 2 is a cross-sectional view on the line 2—2 of FIG. 1.
Figure 3:
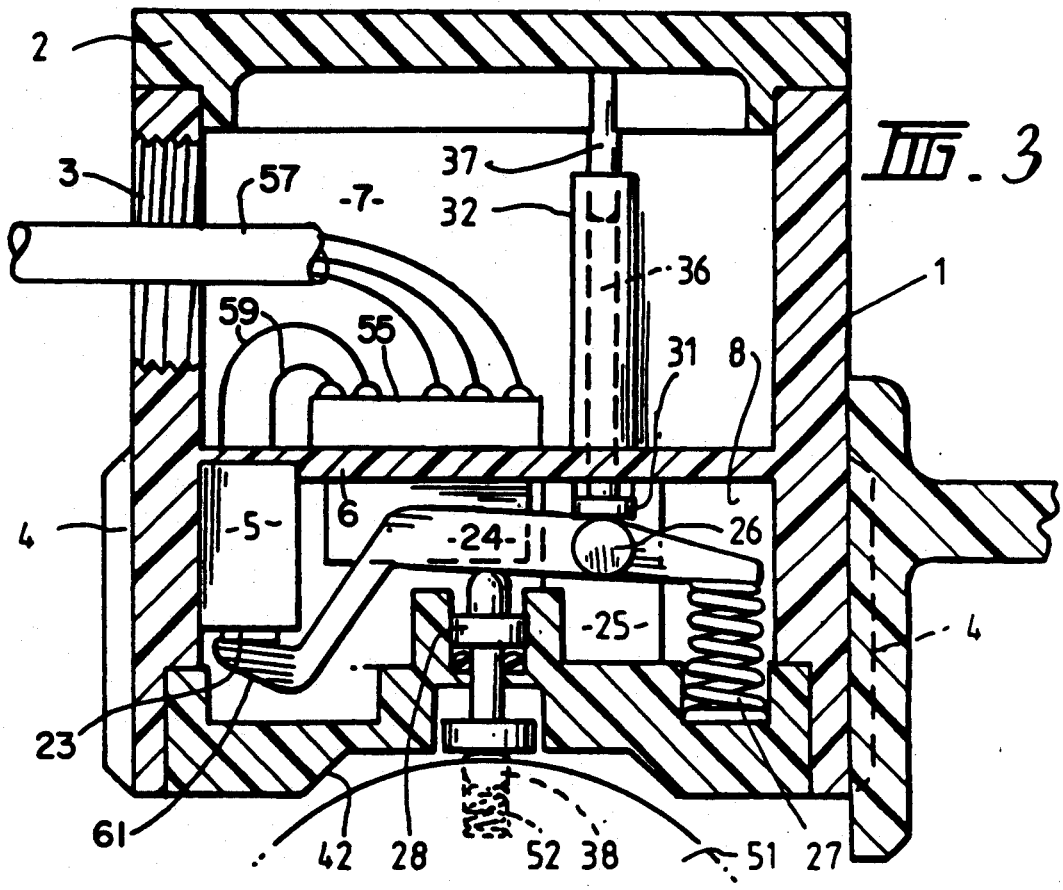
FIG. 3 is a cross-sectionl view on line 3—3 in FIG. 1.
Figure 4:
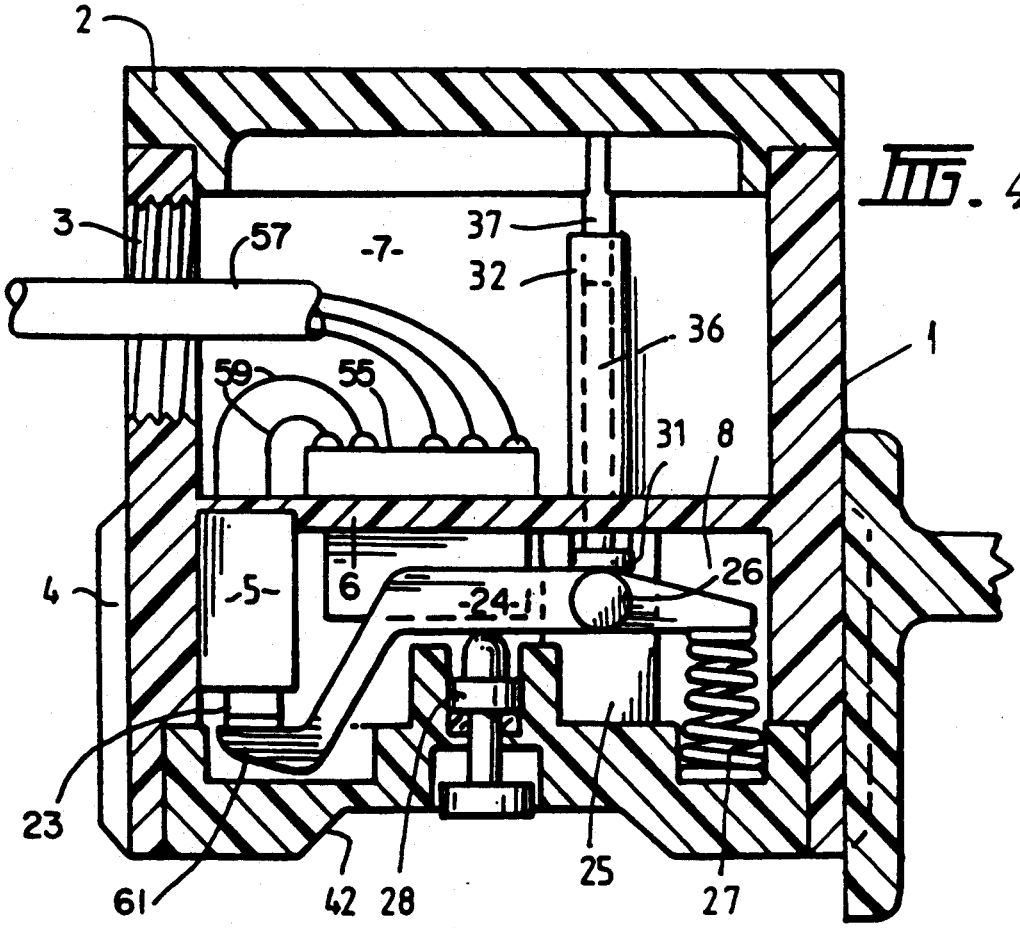
FIG. 4 is a view similar to FIG. 3 showing the mechanism in the inoperative position.

The plunger 23 can be moved by end 61 of a pivoted actuator 24 which is mounted to pivot on pivot pin 26 (FIG. 2). The pivoted actuator 24 is biased by a spring 27 so that the switch 5 is in its normally open circuit condition (FIG. 4) but can be moved against the bias by an operator 28 so as to cause the switch 4 to become closed circuit. In FIG. 3 the switch 5 is shown in the closed circuit condition.

Figure 5:
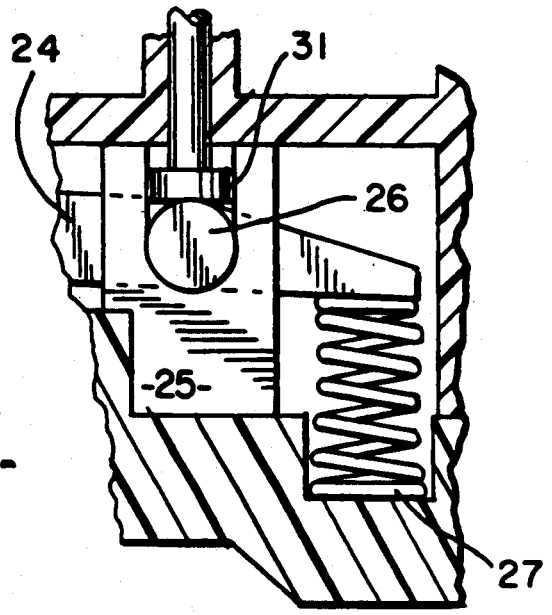
FIG. 5 is a fragmentary view similar to FIGS. 3 and 4 showing the cradle for the actuator.
Figure 6:
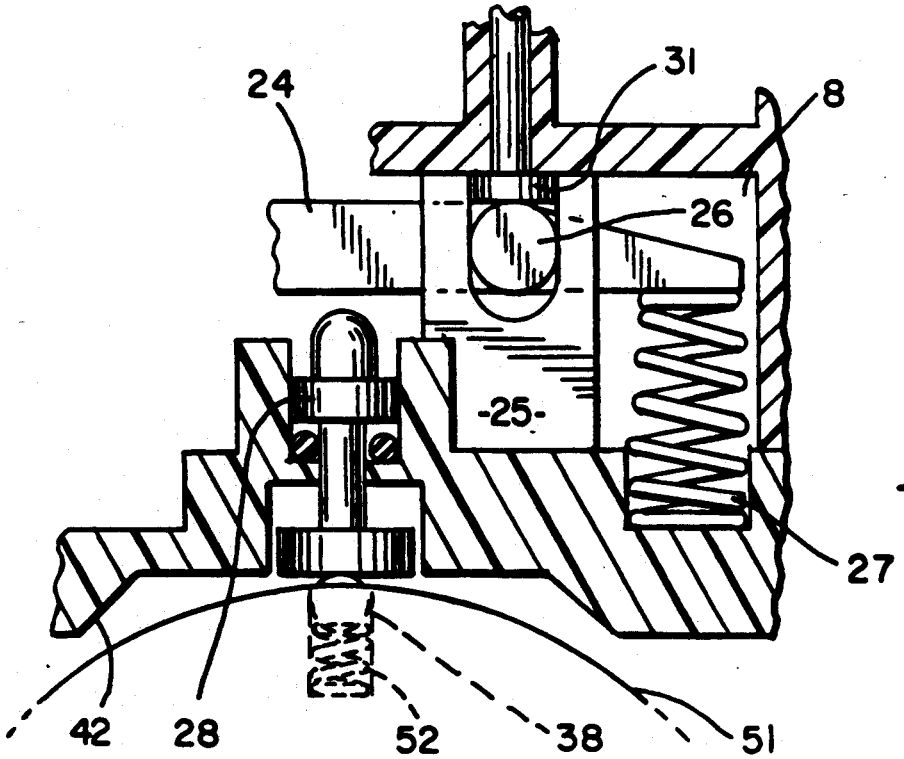
FIG. 6 is a view similar to FIG. 5 showing the floating action of the actuator.

In use, the operator 28 which is a small piston which slides in a bore in the wall of the body, may be associated with a fire sprinkler valve such that when the valve is open the operator 28 will normally be moved upwardly to cause the switch 5 to be closed circuit as shown in FIG. 3 and when the valve is closed the operator 28 will be moved downwardly such that the switch 5 is open circuit. The body 1 is chamfered at 42 to facilitate actuation of the operator 28. Clearly the switch 5 could be of opposite type such that when the actuator 24 pushes the plunger 23 upwardly, as shown in FIG. 3, the switch 5 is in an open circuit condition and is closed when the actuator 24 moves down but this depends entirely on the nature of the external supervisory circuit to which the switch is connected. The ends of pivot pin 26 "sit" in respective U-shaped cradles 63 shown in FIGS. 5 and 6, in end wall members 25 and thus the pivot pin 26 is urged upwardly towards the open ends of the cradles 63 by the spring 27. Adjacent respective ends of the pin 26 discs 31 bear on the pin 26, to retain the ends downwardly in the cradles and the discs 31 are on the bottom ends of respective pushrods 36. The pushrods 36 slide in tubular members 32. Downwardly depending pins 37 are part of the lid 2 and when the lid is in position on the body 3 the pins 37 extend downwardly in respective tubular members 32 and, by contacting the top ends of the respective pushrods 36 cause the pin 26 to be retained in its lowermost or operating position, shown in FIG. 5. When the cover 2 is removed the spring 27 will serve to move the pin 26 upwardly, as shown in FIG. 6 whereby the axis about which the pivoted actuator 24 may pivot will be moved so that movement of the operator 28 of the type which can be expected in normal service will not move the pivotted actuator 24 at all or insufficiently to cause the switch 5 to become closed circuit.

The above described switch will find utility at least in fire sprinkler installations in that removal of the cover 2 or failure to replace the cover 2 can be indicated by the switch 4 being open circuit or changing to the opposite condition to what it is in when everything is in order.

A modification (not shown in the drawings) of the above involves replacing the switch 5 with an electronic switch having a light emitter and a light detector and in which the pivotted actuator 24 is used to interrupt a light path between the emitter and the detector.

The above described switch may be used with the valve spindle 51 and is mounted in close proximity to the spindle 51, as shown, using the mounting lugs 4.

The valve spindle 51 has an aperture 52 within which is located a spring loaded pin 38. The spring urges the pin outwardly of the spindle 51.

In normal use the pin 38 will extend to contact the operator 28 causing the switch 5 to be closed circuit.

However, if the spindle 51 is rotated or is moved axially a short distance, the pin 38, guided in its movement by the chamfer 42, will become out of contact with the operator 28 so causing the switch 4 to become open circuit.

Appropriate electrical circuitry can be provided to indicate when the switch 5 is open circuit to thus indicate that the spindle 51 is not in its operative position or that the switch has been tampered with or not put back to its operative condition.

It will be evident that the "floating pivot" of the actuating mechanism as described above, and shown in FIGS. 5 and 6, provides a unique way of operating the switch when either the valve spindle is moved away from a position wherein the valve is "open", or the switch cover is removed or not properly replaced. The invention enables a single micro-switch to be utilized to monitor both circumstances and is therefore less complicated and less costly to manufacture than known devices of the kind in question.

What is claimed is:

1. An electrical switching mechanism comprising:

a housing;

an electrical switch mounted in said housing and actuatable from a first circuit state to a second circuit state;

an operator member extending through a wall of said housing for movement inwardly and outwardly with respect to said housing;

a switch actuator mounted within said housing for movement with respect to said housing, said switch actuator being engageable by said operator member for moving said switch actuator, said switch actuator engaging said switch for actuating same;

biasing means coupled to said switch actuator for biasing said switch actuator toward a first position in which said switch is actuated to the first circuit state and said operator member is moved outwardly of said housing by contact with said switch actuator, said operator member being capable of being urged inwardly of said housing by a force external of said housing to move said switch actuator against the bias of said biasing means to a second position for actuating said switch to the second circuit state;

removable access cover means on said housing for providing access within said housing; and means within said housing engaging said access cover means and said switch actuator which, upon removal of said cover means, allows said biasing means to move said switch actuator into a condition in which said operator member is unable to operate said switch actuator to the second position.

2. An electrical switching mechanism as defined in claim 1 wherein said switch actuator has at least one pivot pin for pivotally mounting said switch actuator on the housing for arcuate movement with respect to the housing to actuate the switch, the mounting of said switch actuator being such as to allow said biasing means, when said cover means is removed from said housing, to move said switch actuator in a direction normal to the axis of said pivot pin from a normal operating condition in which said switch actuator can assume said first and second positions to the condititon in which said operator member is unable to operate said switch actuator to said second position.

3. An electrical switching mechanism as defined in claim 2 wherein said means within the housing which allows said biasing means to move said switch actuator comprises pushrods extending through the housing, said pushrods bearing on said pivot pin and on said access cover means, whereby removal of said access cover means allows movement of said pushrods normal to said axis of said pivot pin and said biasing means moves said pivot pin from said normal operating conditions to said condition wherein said actuator is not operable by said operator member.

4. An electrical switching mechanism as defined in claim 1 wherein said housing has a partition dividing it into a first chamber containing said switch actuator and said electrical switch and a second chamber for accommodating electrical terminals for making electrical connections to said switch; and wherein removal of said access cover means provides access only to said second chamber.

5. An electrical switching mechanism as defined in claim 1 wherein said switch is further defined as being open when in said first circuit state and closed when in said second circuit state.

6. An electrical switching mechanism as defined in claim 1 wherein said operator member comprises a piston mounted for axial sliding movement in said housing wall, the outer end of said piston having a bearing surface for contact with a projection arranged on the spindle of a fluid control valve, said spindle being arranged closely adjacent said housing, whereby when said projection contacts said bearing surface said piston is caused to operate said actuator to said second position.

7. An electrical switching mechanism as defined in claim 6 wherein said housing has a recessed channel in the wall through which said piston extends, said channel partly accommodating said spindle and preventing access to said piston when said housing is mounted closely adjacent said spindle.

* * * * *